US010299641B2

(12) United States Patent
Käppeli et al.

(10) Patent No.: US 10,299,641 B2
(45) Date of Patent: May 28, 2019

(54) TOILET SEAT HAVING AN AUTOMATIC CLEANING DEVICE

(71) Applicant: CWS-boco International GmbH, Duisburg (DE)

(72) Inventors: Roland Käppeli, Merenschwand (CH); Christian Frei, Oberriet (CH); Marcel Kilga, Hohenems (AT)

(73) Assignee: CWS-BOCO INTERNATIONAL GMBH, Duisburg (DE)

( * ) Notice: Subject to any disclaimer, the term of this patent is extended or adjusted under 35 U.S.C. 154(b) by 0 days.

(21) Appl. No.: 15/758,563

(22) PCT Filed: Sep. 16, 2015

(86) PCT No.: PCT/CH2015/000137
§ 371 (c)(1),
(2) Date: Mar. 8, 2018

(87) PCT Pub. No.: WO2017/045085
PCT Pub. Date: Mar. 23, 2017

(65) Prior Publication Data

US 2018/0255989 A1 Sep. 13, 2018

(51) Int. Cl.
*A47K 13/30* (2006.01)

(52) U.S. Cl.
CPC ..... *A47K 13/302* (2013.01)

(58) Field of Classification Search
CPC ..... A47K 13/302
USPC ..... 4/233
See application file for complete search history.

(56) References Cited

U.S. PATENT DOCUMENTS

| | | | | |
|---|---|---|---|---|
| 1,207,188 A | 12/1916 | McLean | | |
| 2,465,460 A * | 3/1949 | Kronhaus | A47K 13/302 | 4/233 |
| 4,734,942 A * | 4/1988 | Blanchard | A47K 13/302 | 4/233 |
| 5,813,057 A * | 9/1998 | Descent | A47K 13/302 | 4/233 |
| 6,289,526 B1 * | 9/2001 | Chang | A47K 13/302 | 4/233 |
| 8,136,171 B2 * | 3/2012 | Huang | A47K 13/302 | 4/233 |

FOREIGN PATENT DOCUMENTS

| | | | | |
|---|---|---|---|---|
| EP | 0221017 A1 | 5/1987 | | |
| JP | H01185229 A | 7/1989 | | |
| JP | H0838395 A | 2/1996 | | |
| JP | 2002209797 A * | 7/2002 | A47K 13/302 | |

* cited by examiner

*Primary Examiner* — Erin Deery
(74) *Attorney, Agent, or Firm* — Rankin, Hill & Clark LLP

(57) ABSTRACT

A toilet seat (1) with an automatic cleaning device (10), the toilet seat (1) including: a first assembly (2) with a mounting panel (7) that can be secured to a rear section of a lavatory body (8); and a second assembly (3) which includes a lavatory seat ring (9) able to be driven in the peripheral direction, a bearing frame (29) for the lavatory seat ring (9), a drive device (26) for the lavatory seat ring (9), secured to the bearing frame (29), and a cleaning device (10) for the lavatory seat ring (9), likewise secured to said bearing frame (29). The first and second assembly (3) are pivotally interconnected by means of hinge joints (4).

22 Claims, 5 Drawing Sheets

TOILET SEAT HAVING AN AUTOMATIC CLEANING DEVICE

The invention relates to a toilet seat having an automatic cleaning device according to the preamble of claim 1.

Toilets having a device for automatically cleaning the seat, i.e., the lavatory seat ring, are presently frequently used.

Such a device is known from document EP 0 221 017 A1 [Vögeli et al.]. In this known device, during the cleaning, the lavatory seat ring of the toilet is driven by means of electric motors in the peripheral direction and is cleaned using water and/or a disinfecting liquid by means of an extendable and retractable cleaning arm. This known device has the disadvantage, however, that the bearing for the lavatory seat ring and the cleaning device are installed on a one-piece support plate, which extends over the entire upper side of the lavatory body and therefore either the lavatory seat ring cannot be folded up during the cleaning of the toilet or possible hinge joints have to be arranged with difficulty and little stability on the rear side of the lavatory body.

The invention wishes to provide a remedy here. The invention is based on the object of providing a toilet seat securable in a rigid manner to a lavatory body, having automatic cleaning and a fold-up lavatory seat ring, such that no alignment drift can occur between the cleaning arm and the lavatory seat ring during the installation and upon use of the toilet.

The invention achieves the stated object with a toilet seat having an automatic cleaning device, which has the features of claim 1.

The advantages achieved by the invention can essentially be seen in that thanks to the toilet seat according to the invention:

- because of the division of the toilet seat into a first assembly, which is permanently installable on the lavatory body, and a second assembly pivotable in relation thereto by means of a preferably metallic mounting panel, a rigid securing of the toilet seat on the lavatory body is achievable;
- because of the hinge joints mounted on the mounting panel, the forces acting on the lavatory seat ring are transmitted directly to the lavatory body via the mounting panel;
- the bearings of the lavatory seat ring and the cleaning arm are arranged on a one-piece bearing frame, whereby the bearing of the lavatory seat ring is fixed in relation to the pivot joint of the cleaning arm in a rigid manner, so that no alignment drift arises between the lavatory seat ring and the cleaning arm as a result of the forces acting on the lavatory seat ring; and
- cleaning of the toilet could be executed with folded-up toilet seat.

Further advantageous embodiments of the invention can be commented on as follows:

In one special embodiment, the first assembly comprises a housing having a cavity in which at least one container for a disinfectant and/or cleaning agent, a water connection unit, a pump, and preferably electrical components for the power supply and controller are arranged. Due to the arrangement of these components in the first assembly, a favorable space allocation results, because therefore only the cleaning arm and the mechanical drive elements for the movement of the lavatory seat ring in the peripheral direction and for the drive of the cleaning arm are arranged in the second assembly, and therefore the second assembly forms an easily pivotable unit. Furthermore, the mounting panel, which is arranged in the first assembly, may rest on the rear section of the lavatory body located behind the toilet bowl, be aligned using leveling screws, and stably fixed to the lavatory body.

In another embodiment, the hinge joints comprise first joint parts arranged on the mounting panel and second joint parts arranged on the bearing frame and the hinge joints have a common axis of rotation arranged transversely in relation to the toilet seat. The advantage is thus achievable that the hinge joints are arranged on the load-bearing parts of the toilet seat, whereby a stable execution of the hinge joints and therefore the pivotable connection between the first and the second assemblies is enabled.

In another embodiment, the cleaning device for the lavatory seat ring comprises a cleaning arm, which is pivotable about a pivot axis perpendicular to the bearing frame. Because the cleaning arm is pivoted out, instead of being displaced linearly toward the lavatory seat ring, for example, the rear section of the bearing frame can be formed short in a direction perpendicular to the rear side of the lavatory body.

In a further embodiment, the cleaning arm has a longitudinal axis, which is perpendicular to the pivot axis, and the cleaning arm is movable from an idle position, in which the longitudinal axis is parallel to the axis of rotation of the hinge joints, into a cleaning position, in which the longitudinal axis is perpendicular to the axis of rotation of the hinge joints.

In a further embodiment, the cleaning device comprises a cleaning head, which is detachably securable to the cleaning arm, having at least two wipers, which are arranged substantially parallel to the longitudinal axis of the cleaning arm when the cleaning head is installed on the cleaning arm.

In still a further embodiment, the cleaning arm comprises a water nozzle and a nozzle for a water/disinfectant and/or cleaning agent mixture. The advantage is thus achievable that the water sprayed onto the lavatory seat ring by the water nozzle causes a rough cleaning action, while a final cleaning of the lavatory seat ring is performed by the mixture sprayed onto the lavatory seat ring by means of the second nozzle.

In another embodiment, the cleaning head comprises two seat ring wipers, which are arranged essentially in parallel, wherein the nozzle for the water/disinfectant and/or cleaning agent mixture sprays the mixture onto the lavatory seat ring between the two seat ring wipers.

In another embodiment, the cleaning head additionally comprises a lateral wiper, which is arranged essentially parallel to the seat ring wipers and last in the peripheral direction of the lavatory seat ring.

In another embodiment, the cleaning device comprises a drive for the cleaning arm, wherein the drive comprises a first servomotor for a pivot movement and a second servomotor for a lift movement.

In still another embodiment, the drive device for the lavatory seat ring comprises an electric motor having a gearing and a toothed belt drive.

In a further embodiment, the lavatory seat ring comprises an oval or elliptical seat and a circular-cylindrical section, which is arranged below the seat, having a sprocket, and the toothed belt drive comprises a toothed belt and a drive wheel engaging in the sprocket.

In a further embodiment, the second assembly comprises a locking device, which is arranged on the bearing frame, for locking the lavatory seat ring in a correct position in the peripheral direction.

In another embodiment, the locking device comprises a drive, preferably a servomotor, which actuates a spring-loaded bolt, which can be engaged with or disengaged from the lavatory seat ring.

In another embodiment, the drive device for the lavatory seat ring is secured to the bearing frame via damping elements. The advantage is thus achievable that the drive device is secured to the bearing frame in a "floating" manner by means of the damping elements, for example, rubber grommets, so that the background noise is damped.

In a further embodiment, the toilet seat comprises a capacitive sensor for user recognition.

In a further embodiment, the toilet seat additionally comprises a radar sensor for user recognition. This embodiment has the advantage that standing users can also be recognized by the radar sensor.

In a further embodiment, the lavatory seat ring is mounted so it can slide on the bearing frame in the peripheral direction and is preferably detachably securable to the bearing frame by means of a bayonet fitting.

In another embodiment, the electrical components for the power supply, which are arranged in the housing of the first assembly, comprise an electrical power supply unit.

In another embodiment, the housing comprises a housing cover, and the electrical components for the power supply are batteries, which are insertable into the housing cover.

In still another embodiment, at least one hinge joint is equipped with a rotation damper.

In a further embodiment, the second assembly comprises at least one drain pan arranged in the bearing frame. It can be ensured by an overflow in the first assembly, which opens into the drain pan in the bearing frame, that overflowing liquid can drain in a controlled manner.

In a further embodiment, the second assembly comprises a cover having a flap for the cleaning arm, wherein the bearing frame is covered outside the lavatory seat ring by means of the cover.

The second assembly preferably comprises a light, by means of which the cleaning status of the lavatory seat ring can be displayed on the flap.

In one special embodiment of the toilet, the second assembly can be folded up in relation to the toilet.

The invention and refinements of the invention will be explained in greater detail hereafter on the basis of the partially schematic illustrations of multiple exemplary embodiments.

Figure 1:
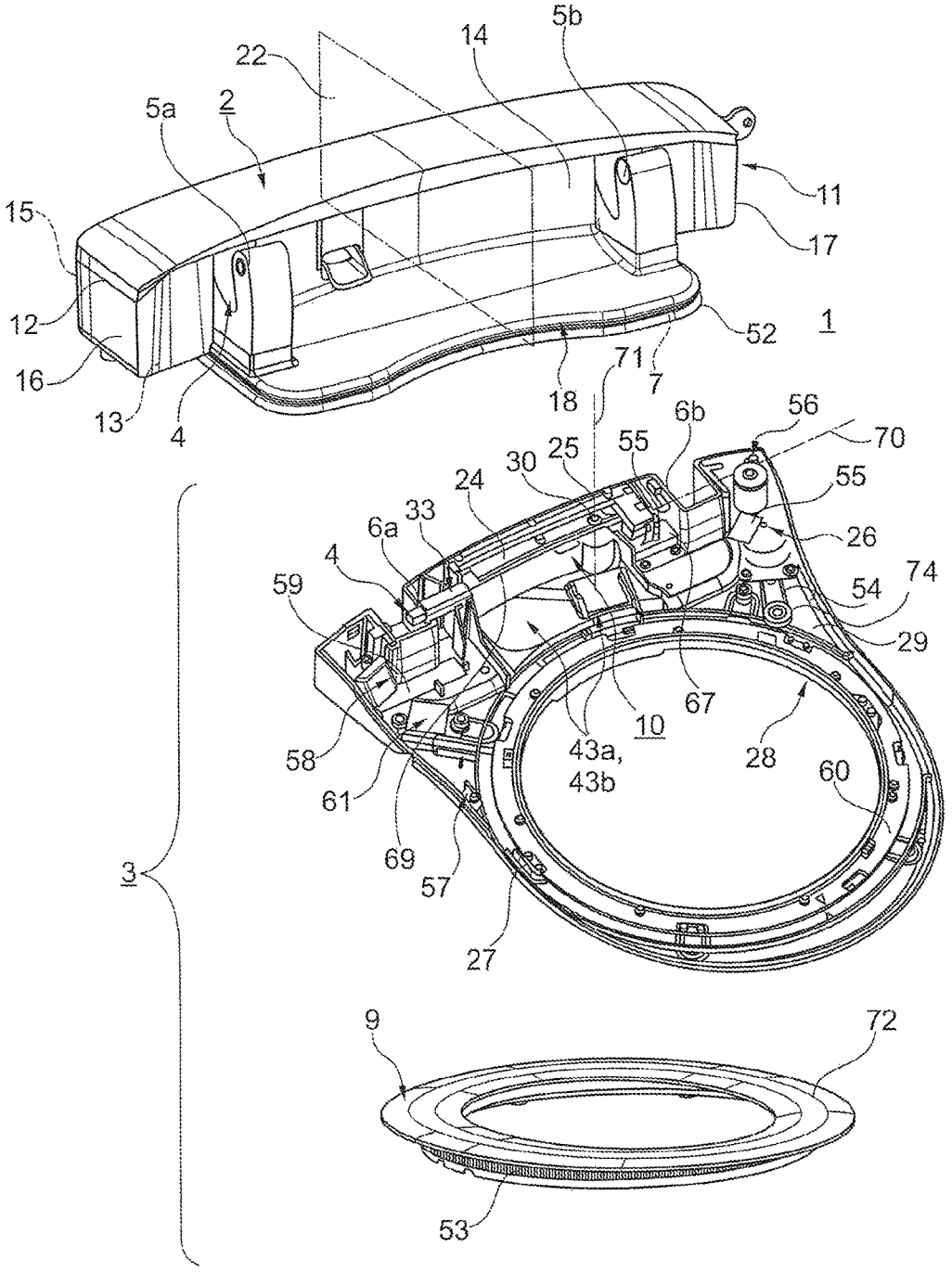
FIG. 1 shows a perspective exploded illustration of an embodiment of the toilet seat according to the invention.

The embodiment of the toilet seat 1 according to the invention illustrated in FIGS. 1 to 9 essentially comprises a first assembly 2 having a mounting panel 7 (FIG. 2) securable to a lavatory body 8 (FIG. 5), which is preferably manufactured from ceramic, of a toilet, and a second assembly 3, which is pivotably secured to the first assembly 2 by means of hinge joints 4, having the lavatory seat ring 9 drivable in the peripheral direction and an automatic cleaning device 10 for the lavatory seat ring 9. The mounting panel 7 is produced by way of example (and not restrictively) from stainless steel and is securable to the lavatory body 8 in a rear section thereof.

The first assembly 2 essentially comprises a housing 11 having a cavity 19 (FIGS. 3 and 4), in which the container 35 for the disinfectant and/or cleaning agent, the reserve tank 40, the water connection unit 34, a pump 36, and the electrical components 45, 46 for the power supply and controller are arranged.

Figure 5:
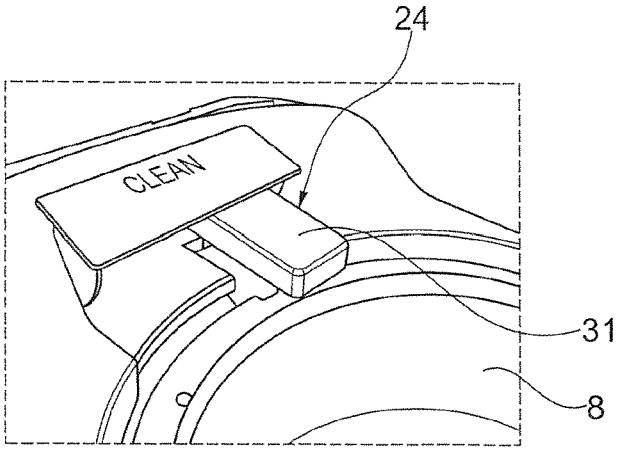
FIG. 5 shows an enlarged view of the extended cleaning arm of the embodiment of the toilet seat according to the invention illustrated in FIG. 1.
Figure 6:
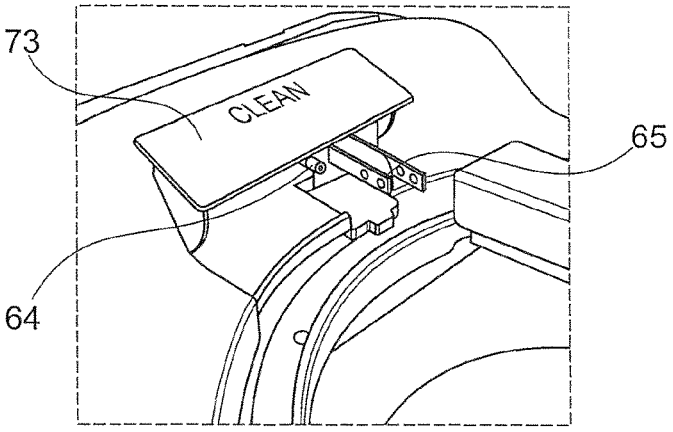
FIG. 6 shows an enlarged view of the extended cleaning arm of the embodiment of the toilet seat according to the invention illustrated in FIG. 1 without cleaning head.
Figure 7:
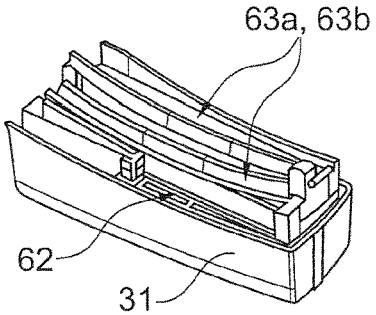
FIG. 7 shows an enlarged view from below of the cleaning head of the embodiment of the toilet seat according to the invention illustrated in FIG. 1.
Figure 8:
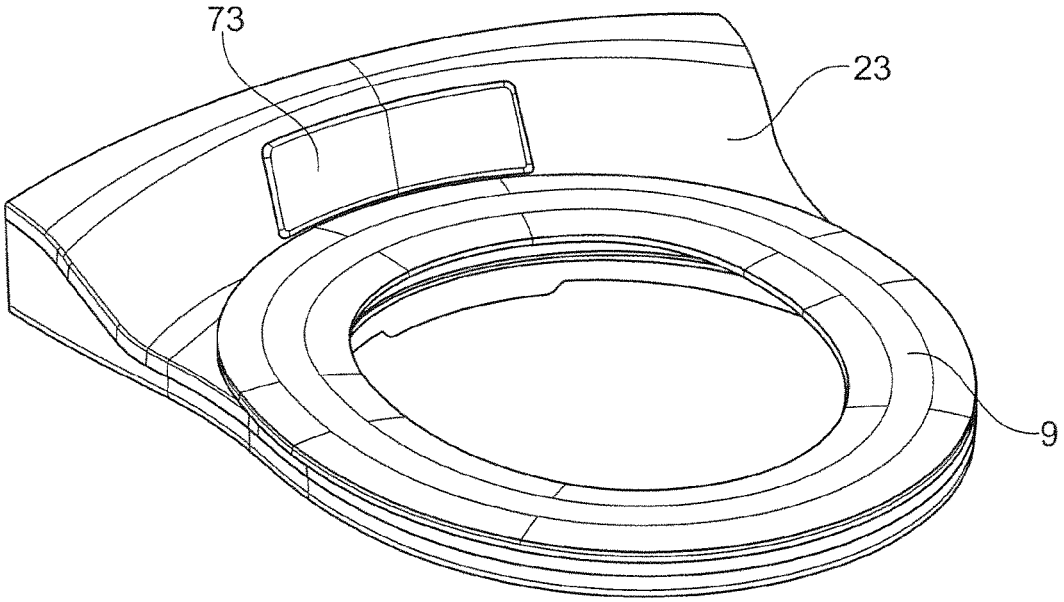
FIG. 8 shows a perspective view of the second assembly of the embodiment of the toilet seat according to the invention illustrated in FIG. 1.
Figure 9:
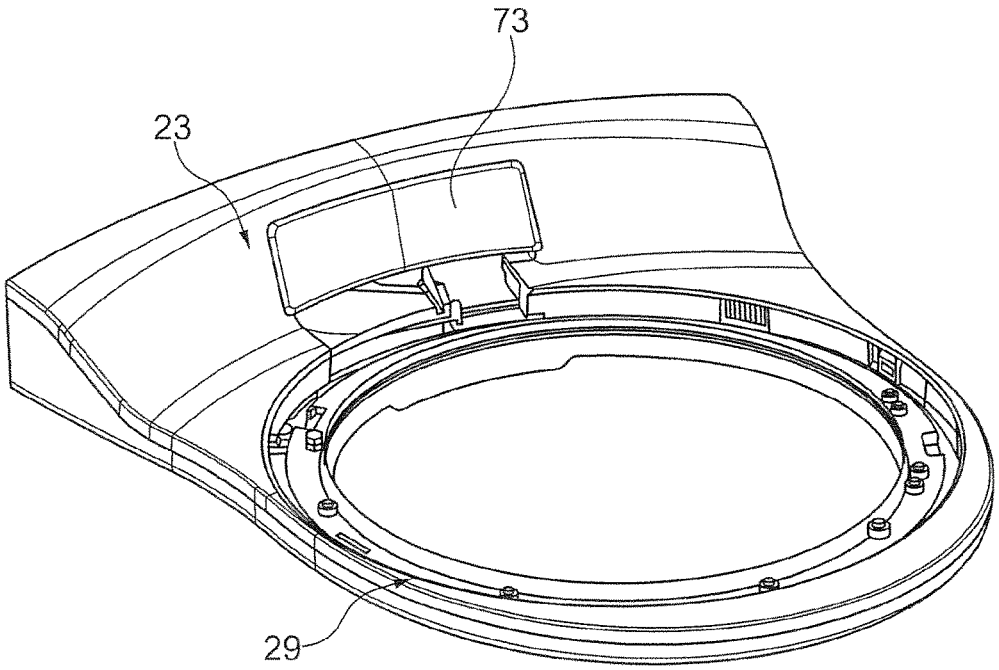
FIG. 9 shows a perspective view of the second assembly of the embodiment of the toilet seat according to the invention illustrated in FIG. 1 without lavatory seat ring.

The second assembly 3 comprises in particular the lavatory seat ring 9, drivable in the peripheral direction, a bearing frame 29 for the lavatory seat ring 9, a drive device 26 for the lavatory seat ring 9, secured to the bearing frame 29, and a cleaning device 10 for the lavatory seat ring 9, also secured to the bearing frame 29. Since the first and second assemblies 3 are pivotably connected to one another by means of hinge joints 4, the second assembly 3 can be folded up in relation to the lavatory body 8 (FIG. 5).

Electrical cable connections and liquid lines are arranged in the region of the hinge joints 4, by means of which the water/disinfectant or cleaning agent mixture, electrical power, and signal can be supplied or transmitted, respectively, to the second assembly 3 from the first assembly 2. The liquid lines and electrical connections then have to be disconnected at plug connections in the event of a removal of the second assembly 3.

The hinge joints 4 comprise first joint parts 5*a*, 5*b*, which are arranged on the mounting panel 7, and second joint parts 6*a*, 6*b*, which are arranged on the bearing frame 29. In the embodiment according to FIG. 1, the first joint parts 5*a*, 5*b* comprise bearing boreholes, in which the pins of the second joint parts 6*a*, 6*b* are rotatably mounted. Alternatively, a reverse arrangement of pins and bearing boreholes is also possible.

Because the first joint parts 5*a*, 5*b* of the hinge joints 4 are arranged on the mounting panel 7, it is ensured that the forces acting on the lavatory seat ring 9 are transmitted directly to the lavatory body 8 via the mounting panel 7 and do not act on the housing 11 of the first assembly 2. The hinge joints 4 have a common axis of rotation 70 arranged transversely in relation to the toilet seat 1. Furthermore, the cleaning device 10 for the lavatory seat ring 9 comprises a cleaning arm 24, which is pivotable about a pivot axis 71 perpendicular to the bearing frame 29. The cleaning arm 24 has a longitudinal axis 69, which is perpendicular to the pivot axis 71. The cleaning arm 24 is pivotable from an idle position, in which the longitudinal axis 69 is essentially parallel to the axis of rotation 70 of the hinge joints 4, into a cleaning position, in which the longitudinal axis 69 is perpendicular to the axis of rotation 70 of the hinge joints 4.

The second assembly 3 comprises a bearing frame 29, which has a bearing 28 for the lavatory seat ring 9 rotatable in the peripheral direction in a front section, a drive device 26 for the lavatory seat ring 9 secured in a rear section of the bearing frame 29, a cleaning device 10 for the lavatory seat ring 9, also secured to the rear section of the bearing frame 29, a cover 23 (FIG. 8) for the drive device 26 and the cleaning device 10.

A flap 73 is arranged on the cover 23, which opens upon pivoting out of the cleaning arm 24 and closes again upon pivoting in. Moreover, for example, the designation "CLEAN" is transparently incorporated on the flap 73, so that when the flap 73 is illuminated from the inside, the cleaning status of the toilet seat 1 is displayed to the user.

The pivot joint 30 of the cleaning arm 24 of the cleaning device 10 and the bearing 28 for the lavatory seat ring 9 are secured to the bearing frame 29 of the second assembly 3, so that the bearing 28 of the lavatory seat ring 9 is rigidly fixed relative to the pivot joint 30 of the cleaning arm 24, whereby an alignment drift between the lavatory seat ring 9 and the cleaning arm 24 is avoided.

The second pivot joints 6*a*, 6*b* of the hinge joint 4 are arranged on the rear section of the bearing frame 29. The second joint parts 6*a*, 6*b* can be engaged with the first joint parts 5*a*, 5*b*, so that hinge joints 4 are formed, by means of which the entire bearing frame 29, including lavatory seat ring 9, drive device 26, and cleaning device 10, is pivotably connected to the first assembly 2, which is fixedly arranged on the lavatory body 8, and can be folded up, for example, for cleaning the toilet. The pivot movement of the second assembly 3 in relation to the first assembly 2 is damped by a rotation damper 33, which thus prevents the bearing frame 29 from hitting the lavatory body 8. This rotation damper 33 is integrated into one of the second joint parts 6*a* of the hinge joints 4.

The cleaning device 10 comprises a cleaning head 31 (FIG. 7), which is detachably securable to the cleaning arm 24, having three wipers 62, 63*a*, 63*b*, in particular a lateral wiper 62 and two seat ring wipers 63*a*, 63*b*, which are arranged essentially parallel to the longitudinal axis 69 of the cleaning arm 24 when the cleaning head 31 is installed on the cleaning arm 24. A water nozzle 64 and a nozzle 65 for the water/disinfectant and/or cleaning agent mixture are arranged on the cleaning arm 24 such that the nozzle 65 for the water/disinfectant and/or cleaning agent mixture sprays the mixture onto the lavatory seat ring 9 between the two seat ring wipers 63*a*, 63*b* and the water nozzle 64 sprays the water onto the lavatory seat ring 9 before the first—viewed in the peripheral direction of the lavatory seat ring 9—seat ring wiper 63*a*. The lateral wiper 62—viewed in the peripheral direction of the lavatory seat ring 9—is arranged last on the cleaning head 31 and wipes the lavatory seat ring 9 dry during the pivoting in of the cleaning arm 24.

The drive 25 for the cleaning arm 24 comprises two servomotors (electric motors having control electronics), of which a first servomotor is used for the pivot movement of the cleaning arm 24 about the pivot axis of the pivot joint 30 and a second servomotor is used for the lifting movement of the cleaning arm 24.

Figure 2:
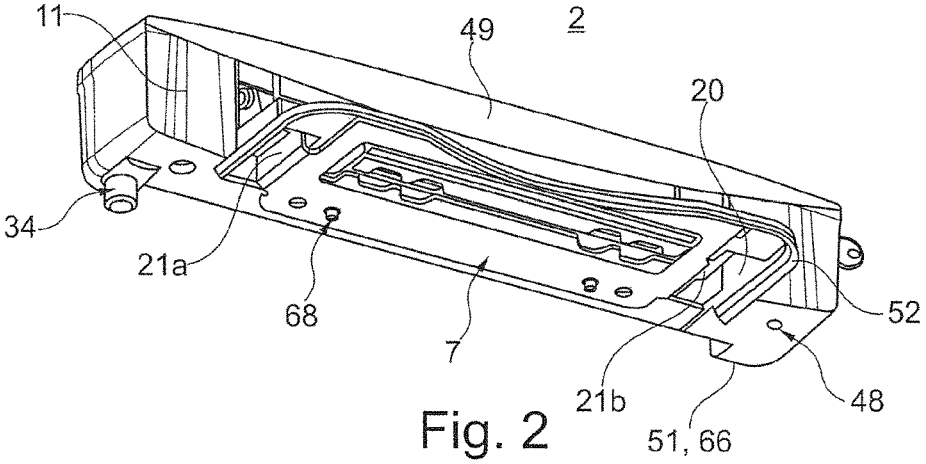
FIG. 2 shows a perspective view from below of the first assembly of the embodiment of the toilet seat according to the invention illustrated in FIG. 1.
Figure 3:
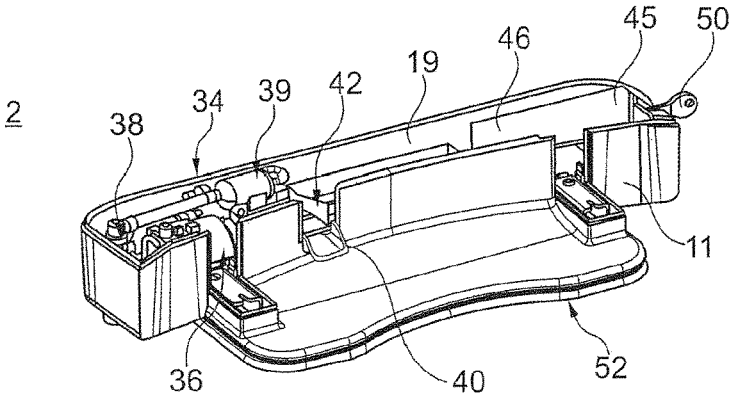
FIG. 3 shows a perspective view of the first assembly of the embodiment of the toilet seat according to the invention illustrated in FIG. 1 without cover.
Figure 4:
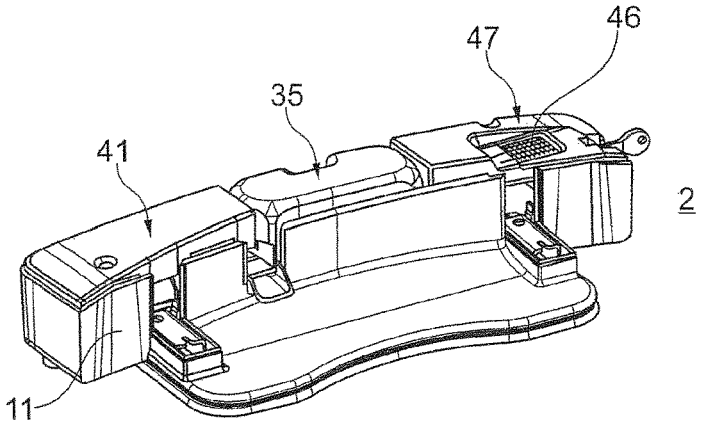
FIG. 4 shows a perspective view of the first assembly of the embodiment of the toilet seat according to the invention illustrated in FIG. 1.

The cleaning head 31 (FIGS. 5-7) is designed so that the lateral wiper 62 and the two seat ring wipers 63*a*, 63*b* can be replaced if needed. The option therefore exists of separately changing the two seat ring wipers 63*a*, 63*b* or replacing the entire cleaning head 31. The cleaning head 31 can be moved into the replacement position by pressing the service button 66 (FIG. 2). Upon pressing on the cleaning head symbol on the operating interface 46, the cleaning arm 24 is pivoted out and the cleaning head 31 can then be replaced. As soon as the new cleaning head 31 is put on, the counter can be reset by pressing it again and the cleaning arm 24 pivots back into its idle position.

The lavatory seat ring 9 comprises an oval or elliptical seat 72 and a circular cylindrical section, which is arranged below the seat 72, having a sprocket 53. The drive device 26 for the lavatory seat ring 9 arranged on the bearing frame 29 essentially comprises an electric motor having a gearing and a toothed belt drive, wherein the toothed belt drive comprises a toothed belt 54 and a drive wheel 74, which engages with the sprocket 53. Furthermore, the second assembly 3 contains a locking device 61 for locking the lavatory seat ring 9, arranged on the bearing frame 29 in a correct position in the peripheral direction, wherein the locking device 61 comprises a servomotor, which actuates a spring-loaded bolt, which can be engaged with or disengaged from the lavatory seat ring 9.

The drive device 26 for the lavatory seat ring 9 forms a subassembly. The drive of the lavatory seat ring 9 for the cleaning cycle takes place, for example, via a 24 V DC motor having a gear stage to achieve the desired speed. The drive device 26 for the lavatory seat ring 9 is secured to the bearing frame 29 in a floating manner via damping elements, for example, rubber grommets, so that the background noise is damped. The force transmission from the gearing to the cylindrical sprocket 53 on the lavatory seat ring 9 takes place via the toothed belt 54 and the drive wheel 74. The speed and/or the position of the lavatory seat ring 9 is determined via a light barrier. In addition, the drive device 26 for the lavatory seat ring 9 comprises a capacitive sensor 56 for the manual triggering of the drive device 26. The capacitive sensor 56 for the manual triggering and the capacitive sensor 57 for the user recognition, which is also arranged on the bearing frame 29, are controlled by the printed circuit board 55. The sensor 57 for the user recognition is arranged below the lavatory seat ring 9 to ensure that a user sitting down is reliably recognized. The user recognition predominantly takes place, however, with the aid of a radar sensor 58, which is also secured to the bearing frame 29, specifically on the side of the bearing frame 29 opposite to the drive device 29. The radar sensor 58 is to also enable standing users to be recognized. The radar sensor 58 is connected to a separate second printed circuit board 59, which comprises the entire controller for the radar sensor 58 and is also secured to the bearing frame 29, via a plug.

The lavatory seat ring 9 is detachably connected to a sliding ring 60, which is rotatably arranged in the bearing frame 29, by means of a bayonet fitting 27.

The first assembly 2 comprises an oblong housing 11, which is arranged at the rear end of the lavatory body 8 in the transverse direction in relation to the latter. The housing 11 has an upper side 12, a lower side 13 facing toward the lavatory body 8, a front side 14 oriented toward the lavatory seat ring 9, a rear side 15, and two lateral ends 16, 17. Furthermore, the housing 11 comprises, in the region of the lower side 13, a projection 18 protruding beyond the front side 14, below which the mounting panel 7 is arranged. The cavity 19 (FIG. 3) is open on the upper side 12 of the housing 11 and extends into the projection 18. On the lower side 13, the cavity 19 is provided with an opening 20, which is used to accommodate the mounting panel 7. The mounting panel 7 is screwed together with the housing 11 and is secured to the lavatory body 8 by means of screws or threaded rods. A seal is produced between the first assembly 2 and the lavatory body 8 on the lower side 13 of the housing 11 by a rubber seal 52, whereby liquid is prevented from being able to flow from the front into the second assembly 2.

The mounting panel 7 additionally comprises two tabs 21*a*, 21*b* (FIG. 2), which are arranged spaced apart from a center plane 22 (FIG. 1) arranged in the middle between the two lateral ends 16, 17 of the housing 11, and on which the first joint parts 5*a*, 5*b* of the hinge joints 4 are arranged.

For toilet bodies 8 having a passage hole, the entire toilet seat 1 can be installed directly on the lavatory body 8. However, if a lavatory body 8 having pocket holes is used, the mounting panel 7 firstly has to be secured to the lavatory body 8. Subsequently, the housing 11 having preinstalled components can be pushed onto the mounting panel 7 and screwed on. In the last step, the second assembly 3 then has to be connected to the mounting panel 7 via the hinge joints 4.

Leveling screws 68 (FIG. 2) are arranged on the mounting panel 7, which rest on the lavatory body 8, so that the mounting panel 7 can be aligned in relation to the lavatory body 8.

The first assembly 2 (FIGS. 2-4) comprises the housing 11, in the cavity 19 of which the water connection unit 34, the replaceable container 35 for the disinfectant and/or cleaning agent, a reserve tank 40 for the disinfectant and/or cleaning agent, the pump 36, and by way of example (and not restrictively) electrical components for the power supply and controller are arranged.

The water connection unit 34 is arranged in the region of the first lateral end 16 and comprises a water connection 37 for service water arranged on the lower side 13 of the housing 11.

By way of example and non-restrictively, the pump 36 is designed as a double-action pump, for example, as a tubing pump having gear stages. The pump 36 suctions the disinfectant and/or cleaning agent from the reserve tank 40, on the one hand, and receives water for the mixture from the pipe interrupter 39, on the other hand. A preferred mixing ratio of water and disinfectant and/or cleaning agent of 25:1 is achieved by different tube diameters, in addition to the gearing stage of the pump 36. Because only small quantities of disinfectant and/or cleaning agent are conveyed, a long usage duration until the next refilling results. The pump 36 conveys the mixture to the cleaning arm 24 (FIG. 5) through a tube. The water intake valve 38, the pipe interrupter 39, and the pump 36 are arranged in the housing 11 of the first assembly 2. The first cover 41 is fixed to the housing 11 by means of a screw. It is ensured by an overflow 42, which opens into a first drain pan 43*a* arranged in the bearing frame 29 of the second assembly 3, that overflowing liquid can drain off in a controlled manner. The overflow 42 is inserted into the housing 11 above the reserve tank 40, wherein the overflow 42 forms the receptacle for the pipe interrupter 39, on the one hand, and provides the receptacle for the fill level monitoring (not shown), on the other hand. The fill level measuring is executed by a capacitive measurement. As soon as the fill level falls below the predefined level, this is signaled via a status LED on the housing 11 of the toilet seat 1.

The electrical components for the power supply and the electronic controller are arranged in the region of the second lateral end 17. The cleaning of the lavatory seat ring 9 is automatically initiated after each usage of the toilet by the electronic controller. The power supply comprises a power supply unit 45 which can be turned on and off, wherein different switching power supply units are usable, which comprise, by way of example and non-restrictively, 230 V AC, 24 V DC, and 12 V DC power supply units, respectively. The cleaning procedure can be triggered via an external controller, via the operating interface 46 connected to the electronic controller, or via the radar sensor 58. The operating interface 46, which is directly connected to the electronic controller on the power supply unit 45 via a power strip, is snapped into the second cover 47. The cover 47 is secured to the housing 11 by means of a screw. With removed second cover 47, the operating interface 46 is also removed, whereby the screw for securing the mounting panel 7 to the lavatory body 8 becomes accessible.

The housing 11 of the first assembly 2 is closable on its upper side 12 by means of a cover 49 (FIG. 2), wherein this cover 49 engages with an undercut in the housing wall at the first end 16 and engages with a detachable snap element in the housing wall at the second end 17. The snap element can be disengaged by pressing the key 50, so that the cover 49 can be removed from the housing 11. The second assembly 3 comprises a cover 23 (FIGS. 8 and 9), by means of which the bearing frame 29 is covered outside the lavatory seat ring 9.

Figure 10:
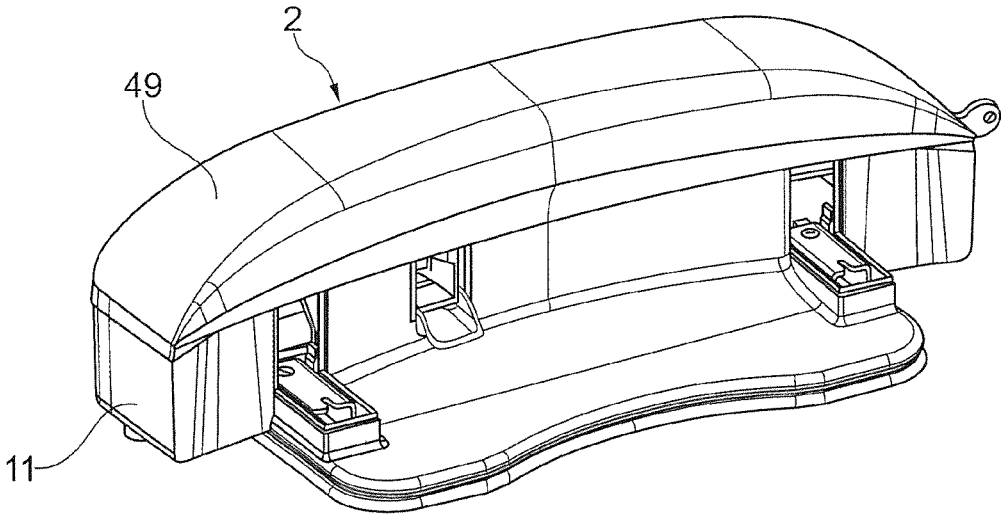
FIG. 10 shows a perspective view of the first assembly of another embodiment of the toilet seat according to the invention with installed housing cover.
Figure 11:
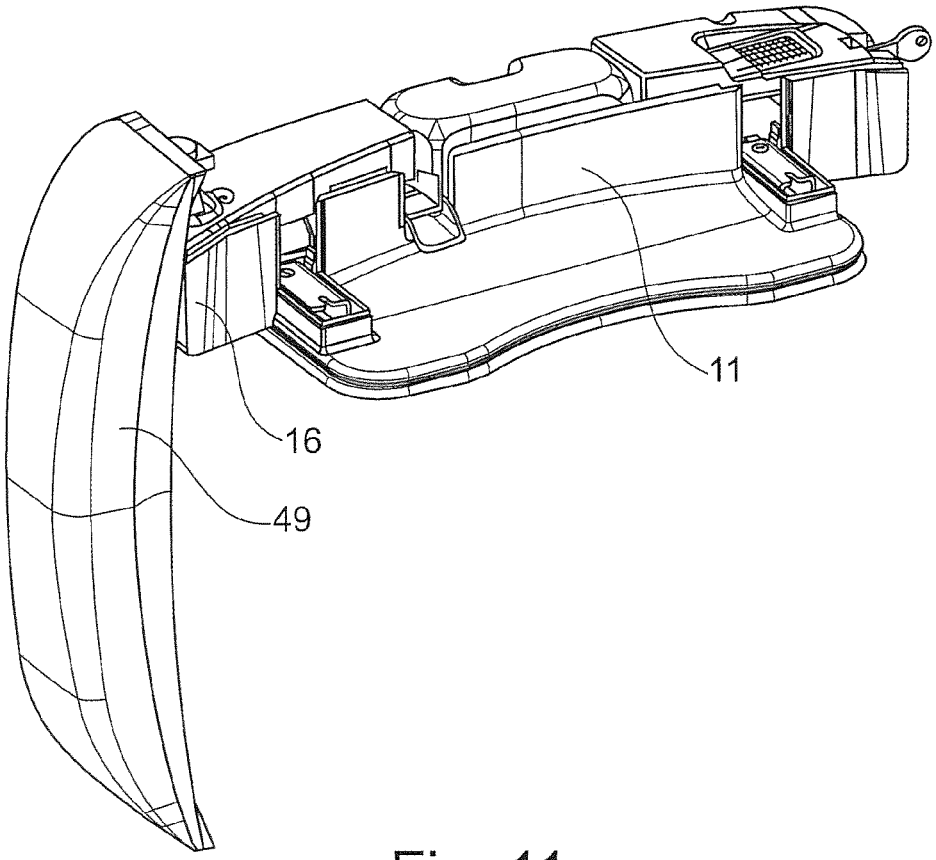
FIG. 11 shows a perspective view of the first assembly of the embodiment of the toilet seat according to the invention illustrated in FIG. 10 with housing cover in the laterally suspended open position.

FIGS. 10 and 11 show a further embodiment of the toilet seat 1 according to the invention, which is supplied with electrical power via batteries (not shown) and which only differs from the embodiment shown in FIGS. 1 to 9 in that instead of the power supply unit, batteries (for example, 8 C cells) are used, which are arranged in the cover 49 of the housing 11. The cover 49 is therefore curved. The second assembly 3 does not differ from the above-described embodiment according to FIGS. 1 to 9.

The electrical contact of the batteries takes place via a spring contact when the cover 49 is put on. If the cover 49 is removed, for example, for a container replacement, the option exists of suspending the cover 49 at the first end 16 of the housing 11, so that the power supply takes place in this case via a cable plug connection. Means are provided in the interior of the cover 49, by means of which the cable for the cable plug connection can be wound up at a defined position, so that pinching of the cable when the cover 49 is put on can be prevented.

Although various embodiments of the present invention as described above are provided, these are to be understood so that the various features can be used both individually and also in any combination.

This invention is therefore not restricted simply to the above-mentioned, particularly preferred embodiments.

The invention claimed is:

1. A toilet seat comprising:

a first assembly having a mounting panel, said mounting panel being securable to a rear section of a lavatory body; and a second assembly, which comprises a lavatory seat ring, a bearing frame for rotatably supporting the lavatory seat ring, and an automatic cleaning device for cleaning the lavatory seat ring, said automatic cleaning device also being secured to the bearing frame;

wherein the first assembly and the second assembly are pivotably connected to one another by hinge joints, wherein the hinge joints have a common axis of rotation, wherein the automatic cleaning device comprises a cleaning arm, which is pivotable about a pivot axis, wherein the cleaning arm has a longitudinal axis, which is perpendicular to the pivot axis, and wherein the cleaning arm is movable from an idle position, in which the longitudinal axis is parallel to the common axis of rotation of the hinge joints and the lavatory seat ring is not rotating on the bearing frame, into a cleaning position, in which the longitudinal axis is perpendicular to the common axis of rotation of the hinge joints and the lavatory seat ring is rotating on the bearing frame.

2. The toilet seat as claimed in claim 1, wherein the first assembly comprises a housing having a cavity, and wherein the cavity contains:

at least one container for a disinfectant and/or a cleaning agent, a water connection unit, a pump, and electrical components.

3. The toilet seat as claimed in claim 2, wherein the electrical components arranged in the housing of the first assembly comprise an electrical power supply unit.

4. The toilet seat as claimed in claim 2, wherein the housing comprises a housing cover, and the electrical components are batteries, which are insertable into the housing cover.

5. The toilet seat as claimed in claim 1, wherein the hinge joints comprise first joint parts arranged on the mounting panel and second joint parts arranged on the bearing frame.

6. The toilet seat as claimed in claim 1, wherein the automatic cleaning device comprises a cleaning head detachably securable to the cleaning arm having at least two seat ring wipers, which are arranged parallel to the longitudinal axis of the cleaning arm when the cleaning head is secured to the cleaning arm.

7. The toilet seat as claimed in claim 6, wherein the cleaning arm comprises a first nozzle for spraying water and a second nozzle for spraying a mixture comprising water and one or more of a disinfectant and a cleaning agent.

8. The toilet seat as claimed in claim 7, wherein the second nozzle is configured to spray the mixture onto the lavatory seat ring between the at least two seat ring wipers.

9. The toilet seat as claimed in claim 8, wherein the cleaning head additionally comprises a lateral wiper, which is arranged parallel to the at least two seat ring wipers.

10. The toilet seat as claimed in claim 1, wherein the cleaning device comprises a drive for the cleaning arm, wherein the drive comprises a first servomotor for a pivot movement and a second servomotor for a lifting movement.

11. The toilet seat as claimed in claim 1, wherein a drive device secured to the bearing frame rotates the lavatory seat ring supported on the bearing frame, and wherein the drive device comprises an electric motor having a gearing and a toothed belt drive.

12. The toilet seat as claimed in claim 11, wherein the drive device for the lavatory seat ring is secured to the bearing frame via damping elements.

13. The toilet seat as claimed in claim 1, wherein the toilet seat comprises a capacitive sensor for user recognition.

14. The toilet seat as claimed in claim 1, wherein the toilet seat further comprises a radar sensor for user recognition.

15. The toilet seat as claimed in claim 1, wherein at least one hinge joint is equipped with a rotation damper.

16. The toilet seat as claimed in claim 1, wherein the second assembly comprises at least one drain pan arranged in the bearing frame.

17. The toilet seat as claimed in claim 1, wherein the second assembly comprises a cover having a flap for the cleaning arm.

18. The toilet seat as claimed in claim 17, wherein the second assembly comprises a light for displaying a cleaning status of the lavatory seat ring on the flap.

19. A toilet comprising a toilet seat as claimed in claim 1 secured to a lavatory body.

20. The toilet as claimed in claim 19, wherein the second assembly is upwardly foldable in relation to the lavatory body.

21. A toilet seat comprising a first assembly and a second assembly, which are pivotably connected by hinge joints, the second assembly having a lavatory seat ring which is rotatably spinable and driven by a drive device including a toothed belt and electric motor, and an automatic cleaning device which includes a cleaning arm pivotable about a vertical axis between an idle position in which a longitudinal axis of the cleaning arm is parallel to a common axis of rotation of the hinge joints and a cleaning position in which the longitudinal axis is perpendicular to the common axis of rotation of the hinge joints.

22. A toilet seat comprising:

a first assembly having a mounting panel that is securable to a rear section of a lavatory body; and a second assembly having a lavatory seat ring including a seat portion for supporting a user in a seated position, and a bearing frame for rotatably supporting the lavatory seat ring, wherein the first assembly and the second assembly are pivotably connected by hinge joints having a common axis of rotation, and wherein the second assembly further comprises an automatic cleaning device which includes a cleaning arm pivotable between:

an idle position in which a longitudinal axis of the cleaning arm does not span across the seat portion of the lavatory seat ring and the lavatory seat ring is not rotating on the bearing frame, and a cleaning position in which the longitudinal axis of the cleaning arm spans across the seat portion of the lavatory seat ring joints and the lavatory seat ring is rotating on the bearing frame.

* * * * *